US010330432B2

(12) United States Patent
Silverman et al.

(10) Patent No.: US 10,330,432 B2
(45) Date of Patent: Jun. 25, 2019

(54) ADJUSTABLE FIREARM STOCK

(71) Applicant: ELEMENTAL ENGINEERING CORP., Fayetteville, GA (US)

(72) Inventors: Ryan Andrew Silverman, Fayetteville, GA (US); Rabun Nolan Vaughn, Jr., Jackson, GA (US); Everett Mcdowell Steil, Cumming, GA (US)

(73) Assignee: Elemental Engineering Corp., Fayetteville, GA (US)

( * ) Notice: Subject to any disclaimer, the term of this patent is extended or adjusted under 35 U.S.C. 154(b) by 0 days.

(21) Appl. No.: 15/801,838

(22) Filed: Nov. 2, 2017

(65) Prior Publication Data

US 2018/0120055 A1 May 3, 2018

Related U.S. Application Data

(60) Provisional application No. 62/416,884, filed on Nov. 3, 2016.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/04; F41C 23/06; F41C 23/10; F41C 23/12; F41C 23/14
USPC ..... 42/71.01, 71.02, 72, 73
See application file for complete search history.

(56) References Cited

U.S. PATENT DOCUMENTS

| | | | | |
|---|---|---|---|---|
| 2,360,881 A | | 10/1944 | Lochhead | |
| 2,424,194 A | * | 7/1947 | Sampson | F41C 23/04 15/104.2 |
| 2,441,487 A | | 5/1948 | Howard | |
| 3,137,958 A | | 6/1964 | Lewis et al. | |
| 3,570,162 A | * | 3/1971 | Suddarth | F41C 23/04 42/72 |
| 4,383,384 A | * | 5/1983 | Fox | F41C 23/04 42/72 |
| 4,896,446 A | | 1/1990 | Gregory | |

(Continued)

FOREIGN PATENT DOCUMENTS

| | | |
|---|---|---|
| WO | 2014078462 | 5/2014 |
| WO | 2018085547 | 5/2018 |

OTHER PUBLICATIONS ar15.com; Web discussion for AR-15 Products, last edit on Jan. 31, 2011, 7 pgs.

(Continued)

*Primary Examiner* — Bret Hayes
(74) *Attorney, Agent, or Firm* — Taylor English Duma LLP

(57) ABSTRACT

A firearm includes: a rail secured to the firearm; and an adjustable firearm stock secured to the rail, the adjustable firearm stock including: a base removably secured to the rail of the firearm and defining an extension element bore; and an extension element positioned in the extension element bore, the extension element configured to move along an axis of the extension element bore. A method of using a firearm includes: mounting a base of an adjustable firearm stock to a rail of the firearm; and sliding an extension element of the adjustable firearm stock through an extension element bore of the base to adjust the adjustable firearm stock to a desired orientation.

21 Claims, 16 Drawing Sheets

(56) References Cited

U.S. PATENT DOCUMENTS

| | | | | |
|---|---|---|---|---|
| 5,711,102 | A | 1/1998 | Plaster et al. | |
| 7,930,849 | B2 | 4/2011 | Abraham et al. | |
| 8,061,072 | B1 | 11/2011 | Crose | |
| 8,127,658 | B1 | 3/2012 | Cottle | |
| 8,464,458 | B2 | 6/2013 | Chvala | |
| 8,776,423 | B2 | 7/2014 | Paquette | |
| 9,097,490 | B2 | 8/2015 | Tseng | |
| 9,927,207 | B1 * | 3/2018 | Haugland | F41C 23/12 |
| 2007/0289190 | A1 * | 12/2007 | Oz | F41C 23/14 42/73 |
| 2009/0282718 | A1 * | 11/2009 | Bartley | F41C 23/12 42/75.03 |
| 2010/0186276 | A1 | 7/2010 | Herring | |
| 2011/0271578 | A1 | 11/2011 | Karagias | |
| 2011/0283584 | A1 | 11/2011 | Walters | |
| 2014/0007763 | A1 | 1/2014 | Foster | |
| 2014/0259848 | A1 | 9/2014 | Chvala | |
| 2015/0159977 | A1 * | 6/2015 | Tseng | F41C 23/04 42/75.03 |
| 2016/0187099 | A1 * | 6/2016 | Cottle | F41C 23/14 42/73 |
| 2016/0282084 | A1 * | 9/2016 | Hollis | F41C 33/001 |
| 2017/0115093 | A1 * | 4/2017 | Chiang | F41C 23/14 |
| 2017/0356718 | A1 * | 12/2017 | Johnson | F41C 23/14 |
| 2018/0003459 | A1 * | 1/2018 | Miller | F41C 23/22 |

OTHER PUBLICATIONS

Armaspec; Article entitled: "XPDW™ Stock", located at <http://armaspec.com/product/xpdw>, accessed on Sep. 9, 2016, 3 pgs.

Midway USA; Article entitled: "Nordic Components Compact Retractable Stock AK-47, AK-74 Stamped Receivers Black", publicly available prior to Nov. 3, 2016, 1 pg.

Silverman, Ryan Andrew; International Search Report and the written opinion for PCT Application No. PCT/US17/59727, filed Nov. 2, 2017, dated May 25, 2018, 11 pgs.

Silverman, Ryan Andrew; Invitation to Pay Additional Fees and, Where Applicable, Protest Fee for PCT Application No. PCT/US17/59727, filed Nov. 2, 2017, dated Mar. 27, 2018, 2 pgs.

* cited by examiner

ADJUSTABLE FIREARM STOCK

REFERENCE TO RELATED APPLICATIONS

This application claims the benefit of U.S. Provisional Application No. 62/416,884, filed Nov. 3, 2016, which is hereby specifically incorporated by reference herein in its entirety.

TECHNICAL FIELD

Field of Use

This disclosure relates to firearms. More specifically, this disclosure relates to an adjustable firearm stock.

Related Art

A firearm such as, for example and without limitation, a semi-automatic rifle can comprise a firearm stock. When placed against the shoulder or other portion of a user's body, a firearm stock can help support and stabilize a first end of the firearm and help absorb any recoil force resulting from a discharge of the firearm during use. The stock of the firearm is typically built into the firearm. While sometimes the stock is adjustable based on the size of a user's body or other factors, the stock is not typically detachable or mountable to an accessory rail of the firearm, much less a standard accessory rail mounted on a side or a top of the firearm. A firearm that cannot be held comfortably and securely by every user can cause fatigue to some users and be less safe or less accurate during use.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is an adjustable firearm stock comprising: a base configured to mount on a firearm comprising: an upper base body defining a first side surface defining an upper jaw, a second side surface distal from the first side surface, a first end surface, a second end surface distal from the first end surface, a top surface, a bottom surface distal from the top surface, an extension element bore extending from the first end surface to the second end surface, and a locking actuator bore extending from a one of the second side surface, the top surface, and the bottom surface into the upper base body; and a locking actuator positioned in the locking actuator bore; an extension element positioned in the extension element bore of the upper base body, the extension element configured to move along an axis defined by the extension element bore by operation of the locking actuator; and an end accessory coupled to the extension element and configured to rest against a user.

In a further aspect, disclosed is a firearm comprising: a rail; and an adjustable firearm stock comprising: a base removably secured to the rail of the firearm and defining an extension element bore; an extension element positioned in the extension element bore, the extension element configured to move along an axis of the extension element bore; and an end accessory secured to the extension element.

In yet another aspect, disclosed is a method of using a firearm comprising: mounting a base of an adjustable firearm stock to a rail of the firearm; and sliding an extension element of the adjustable firearm stock through an extension element bore of the base to adjust the firearm stock to a desired stock orientation.

In yet another aspect, disclosed is an adjustable firearm stock comprising: a base configured to mount on a rail of a firearm, the base comprising: an upper base body defining a first side surface defining an upper jaw, a second side surface distal from the first side surface, a first end surface, a second end surface distal from the first end surface, a top surface, a bottom surface distal from the top surface, an extension element bore extending from the first end surface to the second end surface, and a locking actuator bore extending from a one of the second side surface, the top surface, and the bottom surface into the upper base body; and a locking actuator positioned in the locking actuator bore; and an extension element positioned in the extension element bore of the upper base body, the extension element configured to move along an axis defined by the extension element by operation of the locking actuator.

In yet another aspect, disclosed is a firearm comprising: a rail secured to the firearm; and an adjustable firearm stock secured to the rail, the adjustable firearm stock comprising: a base removably secured to the rail of the firearm and defining an extension element bore; an extension element defining a first end defining a contact surface and a second end distal from the first end, the second end of the extension element extending at least partly through the extension element bore, the second end of the extension element positioned closer to a front end of the firearm than the first end of the extension element, the extension element configured to move along an axis of the extension element bore; and an end accessory secured to the first end of the extension element, the end accessory defining a contact surface having a greater surface area than a surface area of the contact surface of the first end of the extension element.

In yet another aspect, disclosed is a method of using a firearm comprising: mounting a base of an adjustable firearm stock to a rail of the firearm; sliding an extension element of the adjustable firearm stock through an extension element bore of the base to adjust the adjustable firearm stock to a desired orientation; and fixing a position of the extension element relative to the base by engaging a locking actuator of the adjustable firearm stock with the extension element.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
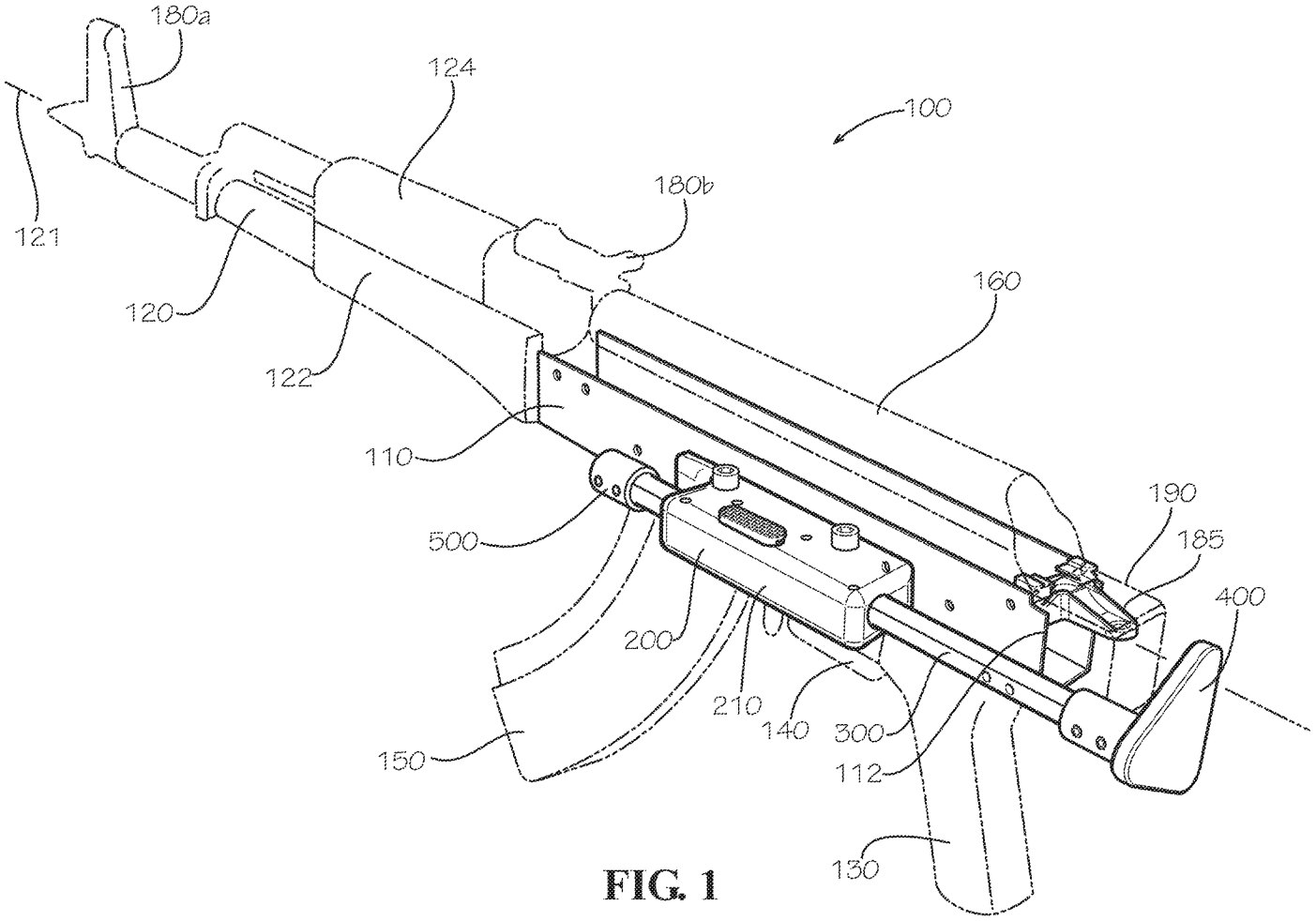
FIG. 1 is perspective view of a firearm comprising an adjustable firearm stock in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list.

To simplify the description of various elements disclosed herein, the conventions of "left," "right," "front," "rear," "upper," "lower," "up," "down," "top," "bottom," "inside," "outside," "inboard," "outboard," "horizontal," and/or "vertical" may be referenced. Unless stated otherwise, "rear" describes that end of the firearm or the adjustable firearm stock nearest to the user when the firearm and/or the adjustable firearm stock is used as intended; "front" is that end of the firearm or the adjustable firearm stock that is opposite or distal from the rear; "left" is that which is to the left of or facing left from the user's perspective; and "right" is that which is to the right of or facing right from the user's perspective. "Upper," "up," and "top" refers to that which is proximate to or facing an upper portion of the firearm or the adjustable firearm stock, while "lower," "down," "and "bottom" refer to that which is opposite or distal from that which is "upper," "up," or "top." "Vertical" or "vertical orientation" describes that which is in a plane extending upwards when the firearm is in an upright position with a bore axis of the firearm in a level position. "Horizontal" or "horizontal orientation" describes that which is in a plane that extends from left to right and normal to the vertical plane when the firearm is in an upright position with a bore axis of the firearm in a level position. When describing features or areas of the firearm or the adjustable firearm stock, it is to be understood that the firearm or the adjustable firearm stock is itself upright and level.

In one aspect, an adjustable firearm stock and associated methods, systems, devices, and various apparatuses are disclosed herein. In one aspect, the adjustable firearm stock can comprise a base and an extension element. In another aspect, the adjustable firearm stock can further comprise an end accessory.

FIG. 1 shows a firearm 100, which can comprise an adjustable firearm stock 200. The firearm 100 can comprise a receiver 110, a barrel 120, a grip 130, a trigger (not shown), a trigger guard 140, an ammunition magazine 150, a dust cover 160, a rail mount plate 170 (shown in FIG. 2), a front sight 180*a*, and a rear sight 180*b*. The receiver 110 can effectively provide a central structure to which various components including the barrel 120, the grip 130, the trigger (not shown), the trigger guard 140, the ammunition magazine 150, the dust cover 160, and the rail mount plate 170 can be attached. The barrel 120, at least a portion of which can be covered with a lower handguard 122 and an upper handguard 124, can define a bore axis 121 of the firearm 100 with which a bullet fired from the firearm 100 is coaxial and along which the bullet is expelled from the firearm 100.

A cavity 112 at the rear of the receiver 110, which can ordinarily be configured to receive a fixed stock (not shown) and a rear trunnion 185 to secure the fixed stock, can also be configured to receive a rear cover 190, which can be a plug. In one aspect, the rear cover 190 can be a molded part that is inserted into the cavity 112 and optionally around the rear trunnion 185. In another aspect, the rear cover 190 can be stamped or fabricated using any other method of manufacture. In yet another aspect, the rear cover 190 can be configured to hinge open and closed. In yet another aspect, the rear cover 190 can be secured to the receiver 110 with fasteners (not shown). In one aspect, the rear cover 190 can be used to cover and protect the rear of the firearm 100 including the rear trunnion 185 from damage such as, for example and without limitation, impact forces or soiling. In another aspect, the rear cover 190 can protect a user from possibly injury by the rear trunnion 185 or otherwise partially assembled rear portion of the firearm 100. In yet another aspect, the rear cover 190 can be configured to receive a quick-disconnect lanyard, sling, or harness or other accessory. In yet another aspect, the rear cover 190 can be used for storage by defining a cavity for inserting an item to be stored.

The firearm 100 can be a rifle; however, in some other aspects, the firearm 100 can be a shotgun or other long gun. In one aspect, the firearm 100 can be an "automatic" firearm in which a single depression of the trigger can fire multiple shots. In another aspect, the firearm 100 can be a "semi-automatic" firearm in which a single depression of the trigger fires only a single shot. In aspects in which the firearm 100 is an automatic firearm or a semi-automatic firearm, an action of the firearm 100 automatically cycles and reloads the chamber (not shown) with ammunition (not shown) from the ammunition magazine 150 after each shot. In yet another aspect, the firearm 100 can be a "manual" firearm in which a single depression of the trigger typically fires only one single shot and does not reload the chamber with ammunition. Manual firearms can comprise various action types such as a bolt action, lever action, or pump action wherein the action can be manually cycled by manipulation of a bolt, a lever, or a pump grip, respectively. For example and without limitation, the firearm 100 can be a type of firearm identified as an AK-47 firearm. Commercial and military variants of the AK-47 firearm and related designs can include, for example and without limitation, models such as an RPK firearm, an AKM firearm, an AK-74 firearm, an AK-101 firearm, an AK-103 firearm, an AK-104 firearm, a SAIGA firearm, a Dragunov firearm, a PSL firearm, an AKSU firearm, or other variants manufactured by any one of a number of manufacturers and countries. However, any firearm can be configured to receive the adjustable firearm stock 200, including by addition of the rail mount plate 170 if such is not already installed.

The adjustable firearm stock 200 can comprise a base 210, an extension element 300, an end accessory 400, and a stop collar 500. The base 210 can be receivable on the firearm 100. The extension element 300 can be receivable within the base 210. The end accessory 400 and the stop collar 500 can be receivable on the extension element 300.

Figure 2:
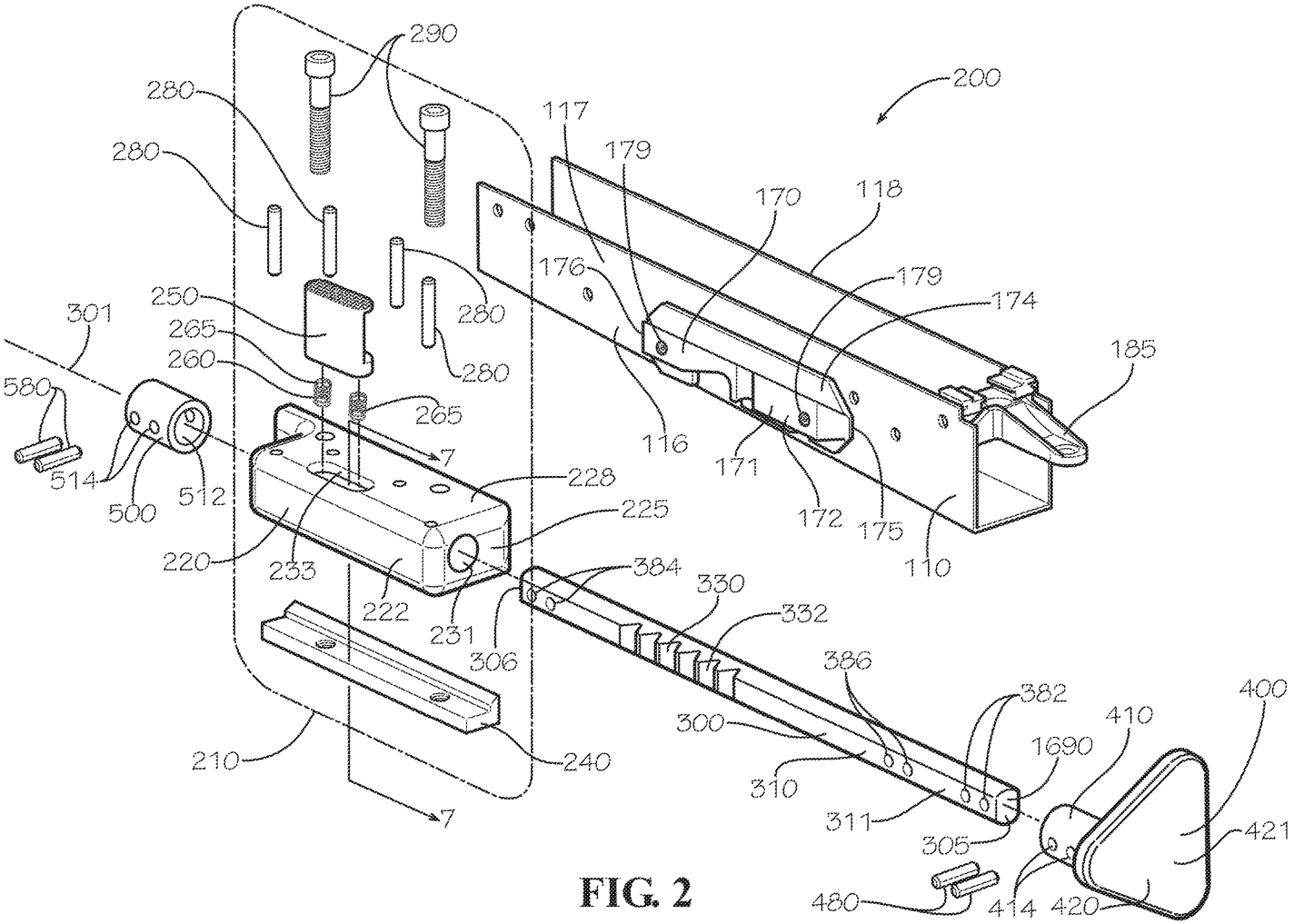
FIG. 2 is an exploded perspective view of the adjustable firearm stock of FIG. 1.

Since permanent modification of the firearm to accommodate an adjustable firearm stock is not always desirable for safety or performance reasons, using a standard accessary rail can be a convenient way to create new functionality. As shown in the exploded view of FIG. 2, the adjustable firearm stock 200 can be mounted to the receiver 110 of the firearm 100 via a rail mount plate 170 that can be configured to be received within a receiving portion 215 (shown in FIG. 4) of the base 210. The rail mount plate 170 can also be referred to as a "side rail scope mount" or a "rail side mount" or simply a "scope mount" or a "rail mount." The rail mount plate 170 is typically used only to mount an optics, which can include, e.g., a scope, a red dot sight, and a holosight, which the user can use to aim the firearm 100. In one aspect, as shown in FIG. 2, the rail mount plate 170 can be mounted to a first side 116 of the receiver 110 ora second side 118 of the receiver 110, which can be opposite from the first side 116 on the firearm 100. The first side 116 and the second side 118 can define a first side vertical surface 117 and a second side vertical surface 119 (shown in FIG. 4), respectively. In another aspect, the adjustable firearm stock 200 can be mounted to any other surface of the firearm 100 as desired, using the rail mount plate 170 or a portion of the firearm 100 that incorporates the geometry of an accessory rail such as the rail mount plate 170. In another aspect, the adjustable firearm stock 200 can attach to an accessory rail formed by a portion of the receiver 110 or the dust cover 160, such as an accessory rail integrally machined into a portion of the receiver 110 or the dust cover 160.

On some firearms, the dust cover 160 can be replaced by an upper receiver. As shown, the rail mount plate 170 itself can be mounted to the firearm 100 using fasteners 179, which, for example and without limitation, can be screws or rivets sized to be received within counterbored holes 178*a, b,c* (shown in FIG. 6) defined in an outer surface 171 of the rail mount plate 170. As shown, the rail mount plate 170 can be mounted to the firearm 100 using a pair of fasteners 179 installed through the counterbored holes 178*a,b,c*. The rail mount plate 170 can comprise a dovetail portion 172 and a mounting portion 174. The dovetail portion 172 can extend from a first end 175 to a second end 176 or along any portion thereof.

Figure 4:
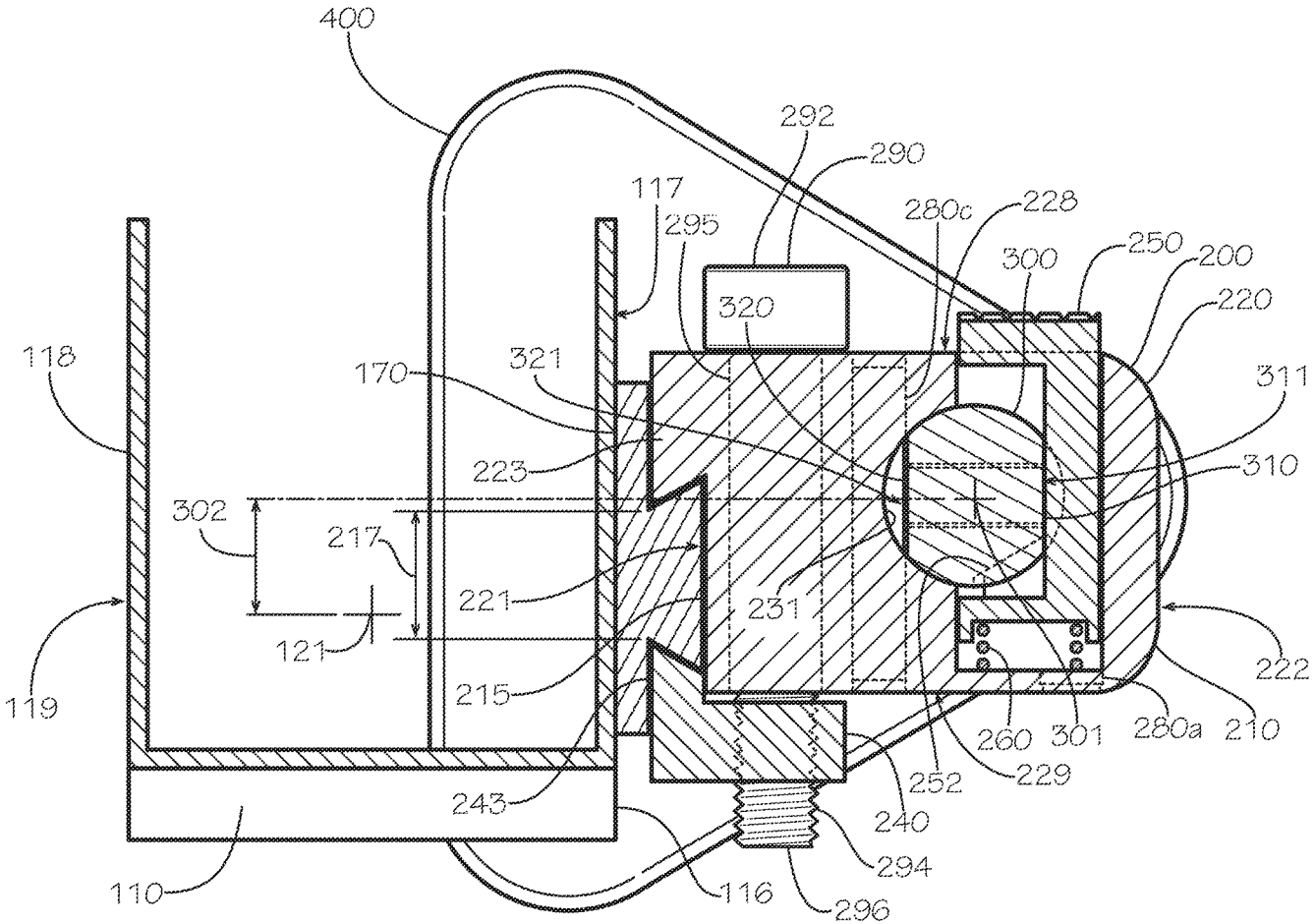
FIG. 4 is a sectional view of the adjustable firearm stock of FIG. 1 taken from line 4-4 of FIG. 3.

In one aspect, the rail mount plate 170 can be a side dovetail rail mount plate, which can comprise a portion having a dovetail shape as shown in the sectional view of FIG. 4. A dovetail shape is that which in cross-section flares out like the tail of a dove in flight in such a way that the "base" of the "tail" is narrower than the "tip" of the "tail." More specifically, as shown in FIG. 2, the rail mount plate 170 can be an AK-type rail mount plate that is typically used on an AK-47 firearm and similar firearms. In another aspect, the rail mount plate 170 can have another cross-sectional shape, and the receiving portion 215 of the base 210 can be shaped to match. While the AK-type rail mount shown in FIG. 2 is a commonly available type, variations in size and shape can be found on some firearms. For example and without limitation, the adjustable firearm stock 200 can be configured to attach to a Picatinny or MIL-STD-1913 rail, which can also be referred to as a "tactical rail"; a Weaver rail; or any rail mount comprising a dovetail shape in cross-section, any of which could be considered an accessory rail 1600 (shown in FIG. 16).

Figure 3:
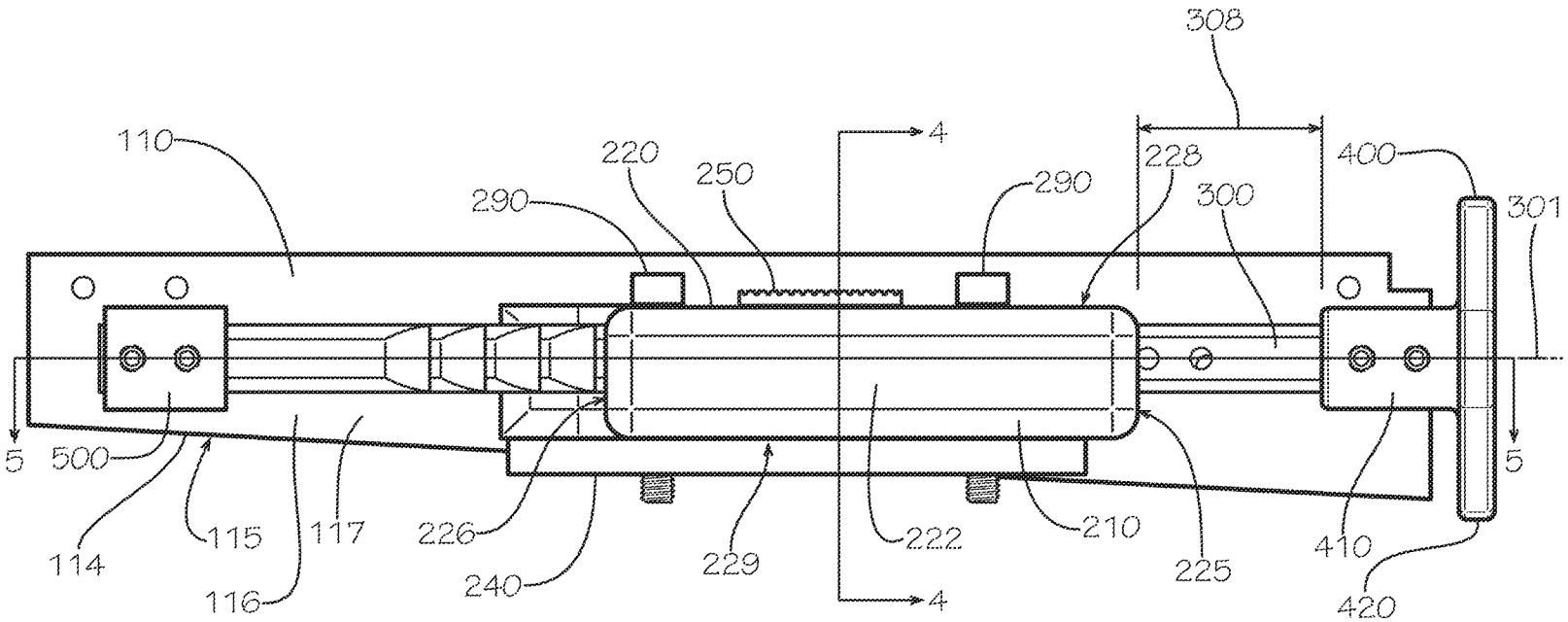
FIG. 3 is a side view of the adjustable firearm stock of FIG. 1.

Also shown in FIGS. 2 and 3, the base 210 can comprise an upper base body 220, a lower base body 240, a locking actuator 250, an activator-biasing mechanism 260 (shown in FIG. 2), pins 280 (shown in FIG. 2), and body assembly fasteners 290. The upper base body 220 can define a first side surface 221 (shown in FIG. 4) defining an upper jaw 223 (shown in FIG. 4) and a second side surface 222 distal from the first side surface 221. The upper base body 220 can define a first end surface 225 and a second end surface 226 (shown in FIG. 3) distal from the first end surface 225. The upper base body 220 can define a top surface 228 and a bottom surface 229 (shown in FIG. 3) distal from the top surface 228. The upper base body 220 can define an extension element bore 231 (shown in FIG. 2) sized to receive the extension element 300 and extending from the first end surface 225 to the second end surface 226. The extension element 300 can be positioned in or inside the extension element bore 231, which can encompass structures and methods in which only a portion of the extension element 300 is positioned inside the extension element bore 231 and a portion of the extension element 300 extends outside of the extension element bore 231. In one aspect, as shown, the extension element bore 231 can be fully enclosed within the base 210 (i.e., visible only at the first end surface 225, at the second end surface 226, or through a locking actuator bore 233). In another aspect, the extension element bore 231 can intersect and be visible at the top surface 228, the bottom surface 229, the first side surface 221, or the second side surface 222 (i.e., the extension element bore 231 can be a groove defined in a surface of the base 210 and configured to receive and retain the extension element 300). In one aspect, as shown, the upper base body 220 can further define the locking actuator bore 233 (shown in FIG. 2) extending from the top surface 228. In another aspect, the locking actuator bore 233 can extend from any other surface of the upper base body 220 such as, for example and without limitation, the second side surface 222 or the bottom surface 229.

The activator-biasing mechanism 260 can comprise at least one spring. In one aspect, the activator-biasing mechanism 260 can comprise a spring 265 such as, for example and without limitation, a coil spring, a wave spring, a leaf spring, or any other kind of spring that can store a potential force upon deformation during movement to an unlocked position and then return a part such as the locking actuator 250 to its original position, which can be a locked position in which the extension element 300 is fixed in position relative to the base 210. As shown, the activator-biasing mechanism 260 can comprise two springs 265 configured to provide equal return force in an upward direction to each of two ends of the locking actuator 250.

The extension element 300, which can be a rod or a shaft in one aspect, can comprise a first end 305 and a second end 306 distal from the first end 305 and can define an axis 301. The second end 306 of the extension element 300 can be positioned closer to a front end of the firearm 100 than the first end 305 of the extension element 300. The extension element 300 can further define an engagement feature 330, which can comprise indentations 332 that are configured to engage the locking actuator 250, as will be described. The extension element 300 can further comprise a first side 310 and a second side 320. The first side 310 and the second side 320 (shown in FIGS. 4 and 5) can comprise a first side surface 311 and a second side surface 321 (shown in FIGS. 4 and 5). In one aspect, each of the first side surface 311 and the second side surface 321 can be a flattened or planar side surface of the otherwise round extension element 300 configured to prevent rotation of the extension element 300 about the axis 301. More specifically, the first side surface 311 and the second side surface 321 can be configured to contact the pins 280 and thereby prevent rotation. In one aspect, the extension element 300 can be substantially cylindrical, i.e., substantially circular in cross-section, when viewed along the axis 301. In another aspect, the extension element 300 can have another shape in cross-section such as, for example and without limitation, a rectangular or polygonal shape. Whatever the shape of the extension element 300 or the first side surface 311 or the second side surface 321 thereof, the extension element 300 can comprise at least one anti-rotation feature that together with the base 210 prevents rotation of the extension element 300 inside the base 210. The extension element 300 can define at least one hole 382 proximate to the first end 305 and at least one hole 382 proximate to the second end 306 for attachment of the end accessory 400 and the stop collar 500, respectively. In another aspect, an adjustable firearm stock can comprise a pair of extension elements, one adjacent to the other and each received within one of a pair of extension element bores defined in the body of the adjustable firearm stock.

In one aspect, the extension element 300 can define at least one hole 386 between the first end 305 and the second end 306 for attachment of a second stop collar 500 (not shown). In another aspect, the end accessory 400 can be removed and a cheek pad (not shown) or other accessory can be secured proximate to the first end 305 of the extension element 300. In yet another aspect, any number and combination of holes 382,386 proximate to the first end 305 of the extension element 300 can be used to secure an end accessory 400 or a pad 450 (shown in FIG. 5), which can include features of the cheek pad. The cheek pad can be a cushioned pad and can be raised from or offset from the extension element 300. The cheek pad can define a padded surface substantially parallel to the bore axis 121. The cheek pad can be configured to align an eye of the user with the sights 180*a,b* or an optic (not shown) when a cheek of the user rests upon the cheek pad. As shown, the extension element 300 defines one pair each of the holes 382,384,386.

The first end 305 of the extension element 300 can define a contact surface 1690, and a second portion 420 of the end accessory 400 can define a contact surface 421. The contact surface 421 can have a greater surface area than a surface area of the contact surface 1690 of the first end 305 of the extension element 300. By having a greater surface area, the contact surface 421 can distribute the force acting on the user, for example, over a greater area and therefore reduce the pressure felt at any single point.

In one aspect, the end accessory 400 can comprise a first portion 410, which can comprise a boss, sized to receive the extension element 300, and the second portion 420, which can comprise a plate. In one aspect, the end accessory 400 can be sized and configured to fit against a portion of the user's body. In another aspect, the end accessory 400 can be sized and configured to receive the pad 450 (shown in FIG. 5), which can be sized to fit against a portion of the user's body and optionally provide a cushion between the end accessory 400 and the user. The first portion 410 of the end accessory 400 can define a central bore 412 (shown in FIG. 5) for receiving the extension element 300 and at least one side bore 414 for receiving a pin 480 that can secure the end accessory 400 to the extension element 300. As shown, the first portion 410 can define a pair of side bores 414, and the end accessory 400 can be secured to the extension element 300 with a pair of pins 480. In another aspect, the end accessory 400 can be secured to the extension element 300 without fasteners. The end accessory 400 can be, for example and without limitation, a butt plate, a butt stock, a stabilizer, a strap, a fin, a flap, a bumper, a plug, a cap, a brace such as an arm brace, or a rounded shape such as a ball, any of which can be secured to the first end 305 of the extension element 300.

The stop collar 500 can comprise a body 510 sized to receive the extension element 300. The body 510 can define a central bore 512 (shown in FIG. 5) for receiving the extension element 300 and at least one side bore 514 for receiving a pin 580 that can secure the stop collar 500 to the extension element 300. As shown, the body 510 can define a pair of side bores 514, and the stop collar 500 can be secured to the extension element 300 with a pair of pins 580. In one aspect, each of the pins 280,480,580 can be a roll pin, which can be referred to as a spring pin. In another aspect, each of the pins 280,480,580 can be any other kind of fastener receivable within the respective bore.

In one aspect, as shown, either of the first end 305 and the second end 306 of the extension element 300 can comprise a plain end. In another aspect, either of the first end 305 and the second end 306 of the extension element 300 can comprise a threaded portion. In one aspect, as shown, either of the central bore 412 of the end accessory 400 and the central bore 512 of the stop collar can be smooth. In another aspect, either of the central bore 412 of the end accessory 400 and the central bore 512 of the stop collar can be threaded, for example and without limitation, to threadably engage the extension element 300. In one aspect, as shown, any of the pins 280,480,580 can have a plain end. In another aspect, any of the pins 280,480,580 can comprise a threaded portion. In one aspect, as shown, any of the bores 288, the holes 382,384,386, and the side bores 414,514 can be smooth. In another aspect, any of the bores 288, the holes 382,384,386, and the side bores 414,514 can be threaded.

As shown in FIG. 3, a bottom end 114 and a bottom surface 115 of the bottom end 114 of the receiver 110 can, for example and without limitation, be angled with respect to the horizontal direction and can be angled with respect to the axis 301 of the extension element 300. The receiver 110 is not limited to any particular size or shape as long as it can receive the adjustable firearm stock 200. The base 210 and the end accessory 400 can define an adjustment distance 308 measured from the first end surface 225 of the base 210 to the first portion 410 of the end accessory 400, the adjustment of which can render the adjustable firearm stock 200 collapsible. The adjustable firearm stock 200 can define an overall extension distance 309 (shown in FIG. 5) from a centerline 177 (shown in FIG. 5) of the rail mount plate 170 to the second portion 420 of the end accessory 400.

As shown in FIG. 4, the upper jaw 223 of the upper base body 220 and a lower jaw 243 of the lower base body 240 can clamp about the dovetail portion 172 of the rail mount plate 170 to effectively secure the base 210 to the firearm 100. A distance 217 between the upper jaw 223 and the lower jaw 243 can be made adjustable by adjusting the body assembly fasteners 290. Each of the body assembly fasteners 290 can comprise a head 292 and a shank 294 having a first end 295 proximate the head 292 and a second end 296 distal from the first end 295.

Figure 5:
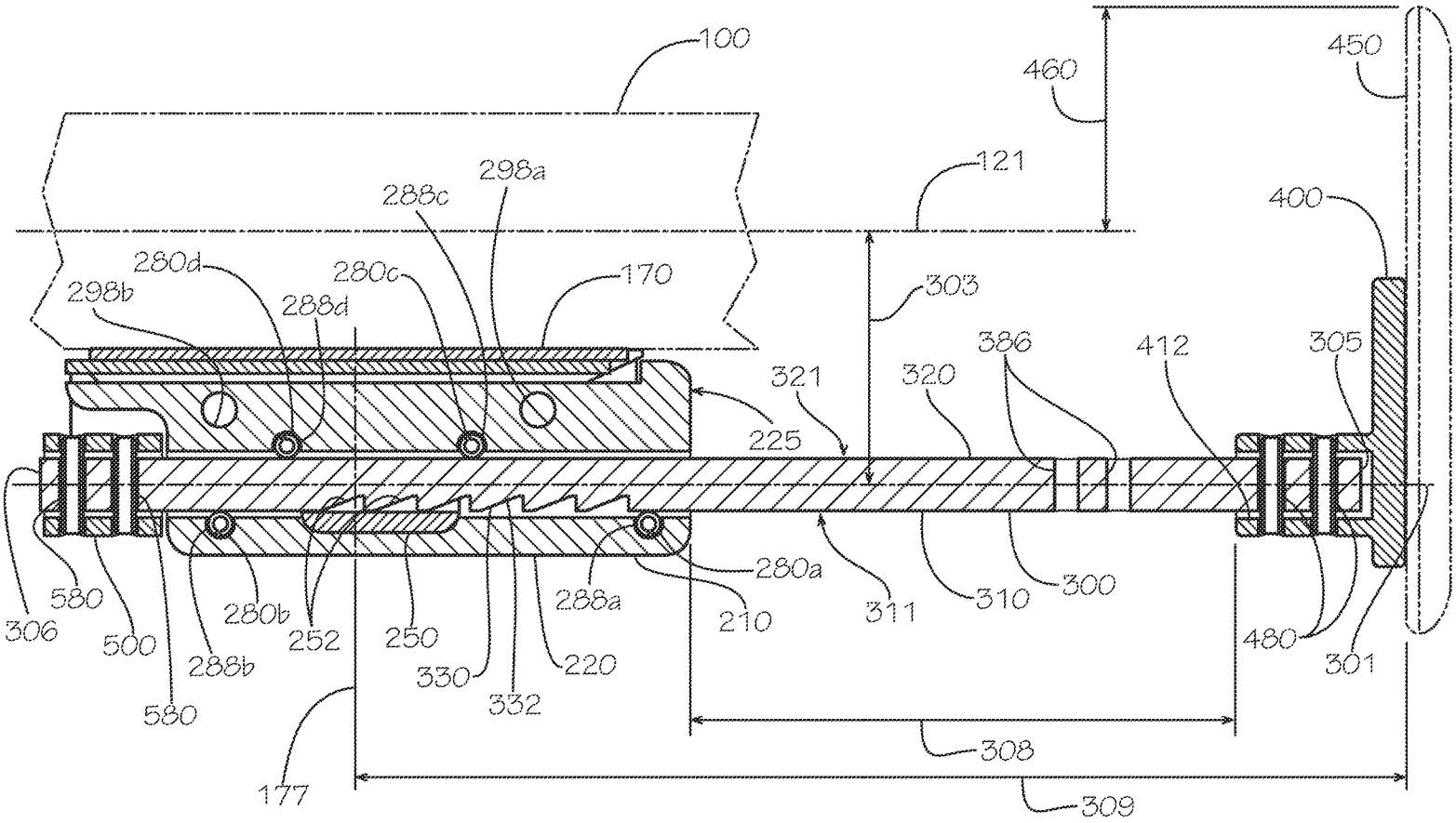
FIG. 5 is a sectional view of the adjustable firearm stock of FIG. 1 taken from line 5-5 of FIG. 3.

In one aspect, as shown in FIG. 4, the axis 301 of the extension element 300 can be offset vertically with respect to (i.e., positioned above or below) the bore axis 121 of the barrel 120 of the firearm 100 by an offset distance 302. In another aspect, the axis 301 of the extension element 300 can be aligned vertically with the bore axis 121 of the barrel 120 of the firearm 100. In one aspect, as shown in FIG. 5, the axis 301 of the extension element 300 can be offset horizontally with respect to the bore axis 121 of the barrel 120 of the firearm 100 by an offset distance 303. In another aspect, the axis 301 of the extension element 300 or a portion of the extension element 300 can be aligned with the bore axis 121 of the barrel 120 of the firearm 100. In one aspect, for example and without limitation, at least a portion of the extension element 300 can be positioned directly to the rear of the barrel 120 so that it is inline with the bore axis 121, by introducing a bend in the extension element 300 so that an axis of the extension element 300 at the first end 305 is aligned with the bore axis 121. In another aspect, for example and without limitation, a bracket (not shown) can be attached to the extension element 300 so that a portion of the bracket intersects with the bore axis 121. In yet another aspect, as shown in FIG. 5, at least a portion of the end accessory 400 or the pad 450 can be sized and positioned to extend sufficiently in a horizontal direction to overlap the bore axis 121 by an overlap distance 460 such that a portion of the adjustable firearm stock 200 pushes back against the kickback of the firearm 100 during firing of the firearm 100 along the bore axis 121.

As shown in FIGS. 4 and 5, the upper base body 220 can comprise assembly bores 298*a,b* (shown in FIG. 5), which can be sized to receive the body assembly fasteners 290 and can extend from the top surface 228 to the bottom surface 229. Each of the assembly bores 298*a,b* can be defined as smooth-bore holes in the upper base body 220. The upper base body 220 can comprise pin bores 288*a,b,c,d* sized to receive the pins 280 and also extending from the top surface 228 to the bottom surface 229. As shown in FIG. 4, the pins 280 installed in the pin bores 288*a,b*, respectively, can contact the first side surface 311 of the first side 310 of the extension element 300, and the pins 280 installed in the pin bores 288*a,b*, respectively, can contact the second side surface 321 of the second side 320 of the extension element 300. Thus the pins 280 together can maintain the tight lateral position of the extension element 300 (i.e., the pins 280 can prevent misalignment of the axis 301 of the extension element 300 with an axis of the extension element bore 231) and prevent rotation of the extension element 300 about the axis 301 while inside the extension element bore 231.

As shown in FIGS. 4 and 5, the engagement feature 330, which can comprise the indentations 332, can be configured to engage teeth 252 of the locking actuator 250. When the locking actuator 250 is in a raised position (i.e., a non-depressed position, which can also be a locked position) as shown in FIG. 4, the teeth 252 of the locking actuator 250 can be made to interlock with the indentations 332 of the engagement feature 330 of the extension element 300. When the teeth 252 interlock with the indentations 332, the extension element 300 can be held stationary inside the extension element bore 231 of the base 201 and cannot move in a direction along the axis 301, i.e., the extension element 300 is locked in place relative to the base 210. In one aspect, as shown in FIG. 4, the teeth 252 can have a triangular shape in cross-section when viewed along the axis 301. In another aspect, as shown in FIG. 5, the teeth 252 can also have a triangular shape in cross-section when viewed from a direction facing downward and can be made to substantially match the triangular shape in cross section of the indentations 332 of the extension element 300 when viewed from the same direction. In yet another aspect, the teeth 252 can comprise any sloped or angled surface.

Figure 6:
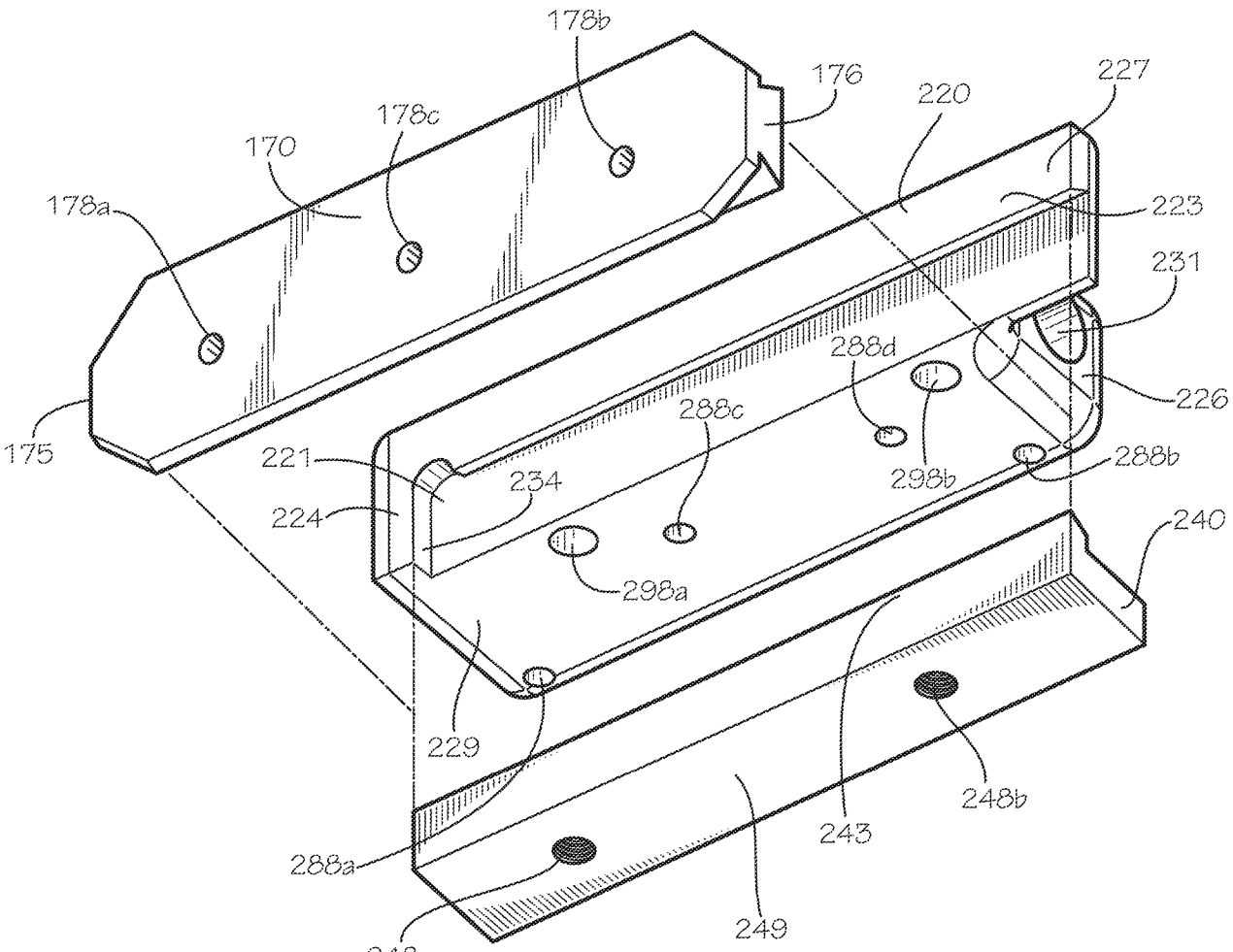
FIG. 6 is a bottom inside sectional perspective view of a base of the adjustable firearm stock of FIG. 1.

As shown in FIG. 6, the upper base body 220 can further comprise a stop portion 224. The stop portion 224 can be defined in the first side surface 221 proximate to the first end surface 225 and can comprise a shoulder 234. The shoulder 234 can face a direction opposite the first end surface 225 (shown in FIG. 3) and towards the first end 175 of the rail mount plate 170 when the rail mount plate 170 is captured within the receiving portion 215 (shown in FIG. 4) of the base 210 (shown in FIG. 4). The stop portion 224 can be useful in preventing the firearm 100 from moving towards the user—for example, during the firing of ammunition from the firearm 100. For example, even when the adjustable firearm stock 200 is not tightened completely around the rail mount plate 170 such that the frictional forces between the adjustable firearm stock 200 and the rail mount plate 170 are insufficient to prevent movement of the adjustable firearm stock 200 with respect to the rail mount plate 170, the presence of the stop portion 224 can prevent such movement. Nonetheless, it can generally be beneficial to completely tighten the adjustable firearm stock 200 around the rail mount plate 170, as the design uniquely allows, to prevent unintended movement of the adjustable firearm stock 200 with respect to the rail mount plate 170 and therefore also prevent unintended movement of the firearm 100 with respect to the adjustable firearm stock 200.

The upper base body 220 can further comprise an extension portion 227, which can be made to extend past the second end surface 226. Likewise, the lower base body 240 can be made to extend past the second end surface 226. Extending the extension portion 227 of the upper base body 220 and the lower base body 240 can increase a length of the receiving portion 215 (shown in FIG. 4) to match a length of the dovetail portion 172 of the rail mount plate 170, which can have the benefit of improving the rigidity of the connection between the adjustable firearm stock 200 and the firearm 100 and preventing the rotation of the adjustable firearm stock 200 with respect to the firearm 100.

Also shown in FIG. 6, the lower base body 240 can comprise assembly bores 248*a,b* sized to receive the body assembly fasteners 290 and can extend from a top surface 247 (shown in FIG. 8A) to a bottom surface 249 of the lower base body 240. Each of the assembly bores 248*a,b* can be defined as tapped holes in the lower base body 240. The assembly bores 248*a,b* can be tapped to receive and engage the body assembly fasteners 290 and specifically the threaded second end 296 of each.

Figure 7:
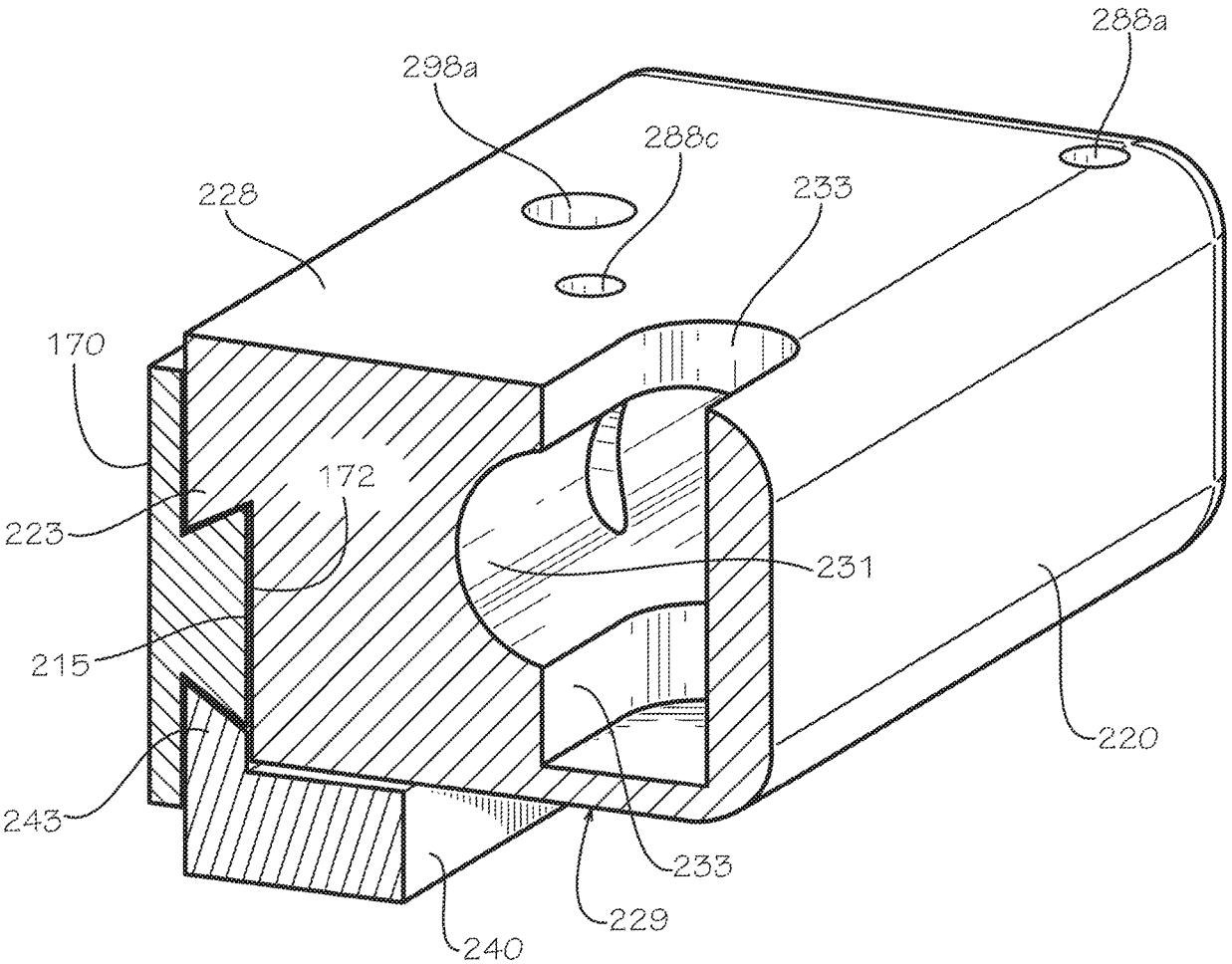
FIG. 7 is a sectional perspective view of the base of FIG. 6.

As shown in FIG. 7, the locking actuator bore 233 can extend from the top surface 228 of the upper base body 220 to a depth between a lowermost portion of the extension element bore 231 and the bottom surface 229 of the upper base body 220. The depth of the locking actuator bore 233 can provide space for the activator-biasing mechanism 260 or any portion thereof—such as the springs 265—in both its compressed and uncompressed states.

Figure 8A:
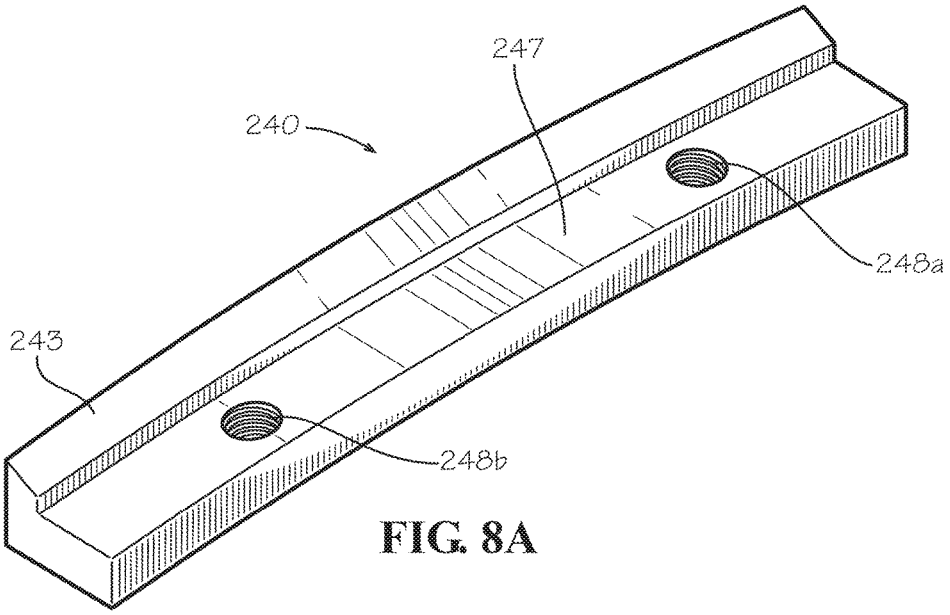
FIG. 8A is a perspective view of a lower base body of the base of FIG. 6.
Figure 8B:
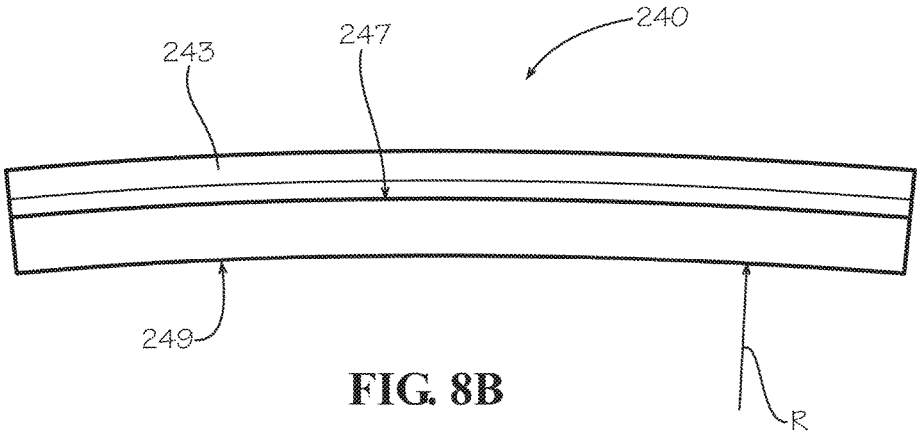
FIG. 8B is a side view of the lower base body of FIG. 6.

As shown in FIGS. 8A and 8B, the lower base body 240 can be bowed or pre-bent before its assembly to the upper base body 220. As shown in FIG. 8B, the bottom surface 249 of the lower base body 240 can define a radius R representing a radius of curvature of the bottom surface 249. Tightening of the body assembly fasteners 290 can bring the lower base body 240 closer to the upper base body 220. When the lower base body 240 is bowed or pre-bent as shown, however slight the bow or bend, tightening the body assembly fasteners 290 can result in the creation of a contact pressure against the upper base body 220 by the lower base body 240 that can thereby increase the friction between the upper base body 220 and the lower base body 240. Increased friction between the upper base body 220 and the lower base body 240 can increase the security and reliability of the connection between the adjustable firearm stock 200 and the rail mount plate 170 of the firearm 100. In another aspect, the lower base body 240 can be bowed or bent in an opposite direction to that shown. In one aspect, the lower base body 240 can be made from spring steel, which is intended to repeatedly elastically deform.

Figure 9:
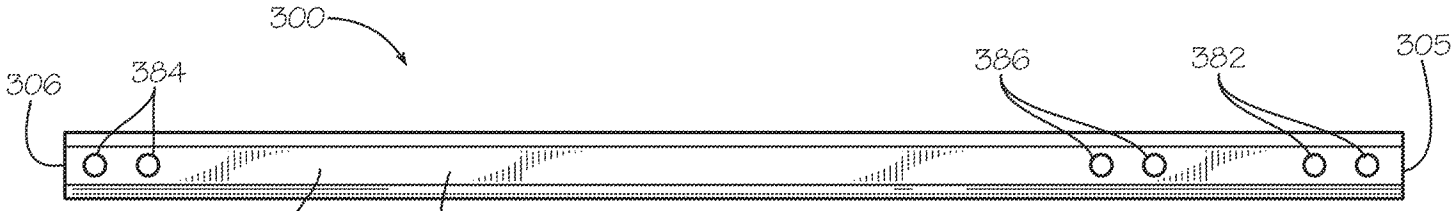
FIG. 9 is a first side view of an extension element of the adjustable firearm stock of FIG. 1.
Figure 10:
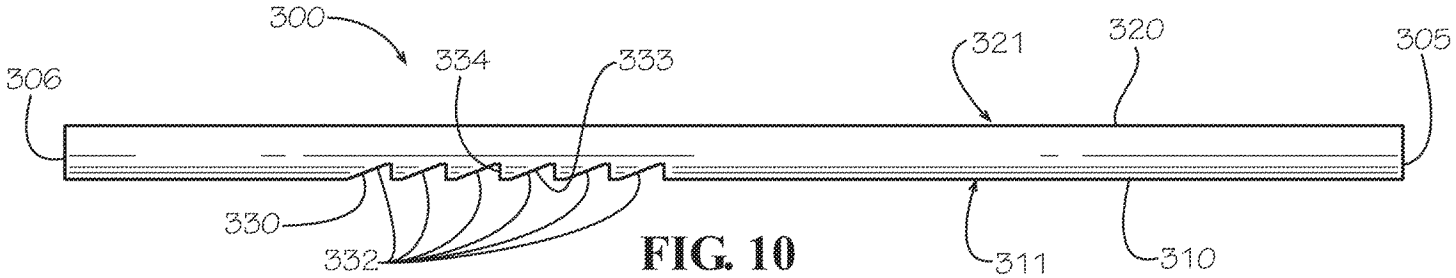
FIG. 10 is a top view of the extension element of FIG. 9.
Figure 11:
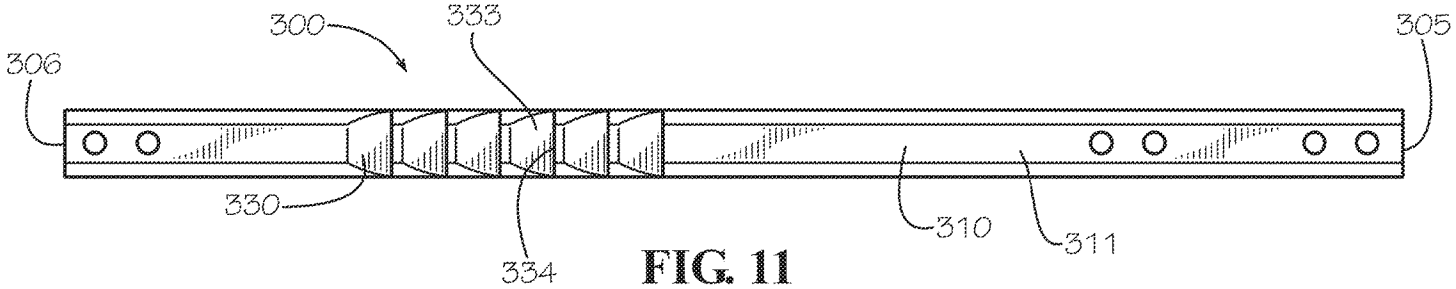
FIG. 11 is a second side view of the extension element of FIG. 9.

As shown in FIGS. 9-11, the extension element 300 can comprise the first side 310, the second side 320, the first end 305, the second end 306, the engagement feature 330, the indentations 332, and the holes 382,384,386. Each of the indentations 332 can comprise a sloping portion 333 and a stop portion 334. Both a surface of the sloping portion 333 and a surface of the stop portion 334 can be angled with respect to the first side surface 311 of the first side 310. In one aspect, a surface of the sloping portion 333 can be angled at an angle of 20 degrees with respect to the first side surface 311. In another aspect, a surface of the sloping portion 333 can be angled at an angle of between zero and 90 degrees with respect to the first side surface 311. In one aspect, a surface of the stop portion 334 can be angled at an angle of 90 degrees with respect to the first side surface 311. In another aspect, a surface of the stop portion 334 can be angled at an angle measuring less than or greater than 90 degrees with respect to the first side surface 311.

Figure 12:
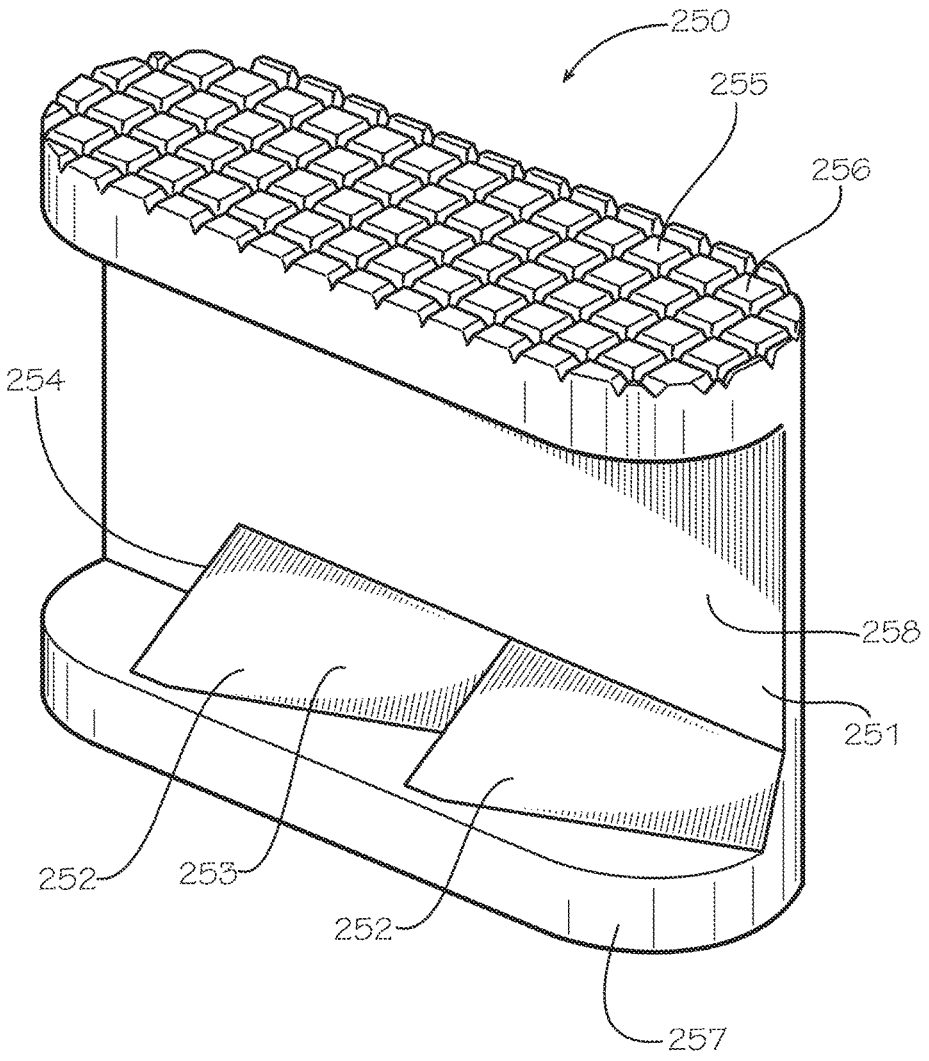
FIG. 12 is a top inside perspective view of a locking actuator of the adjustable firearm stock of FIG. 1.
Figure 13:
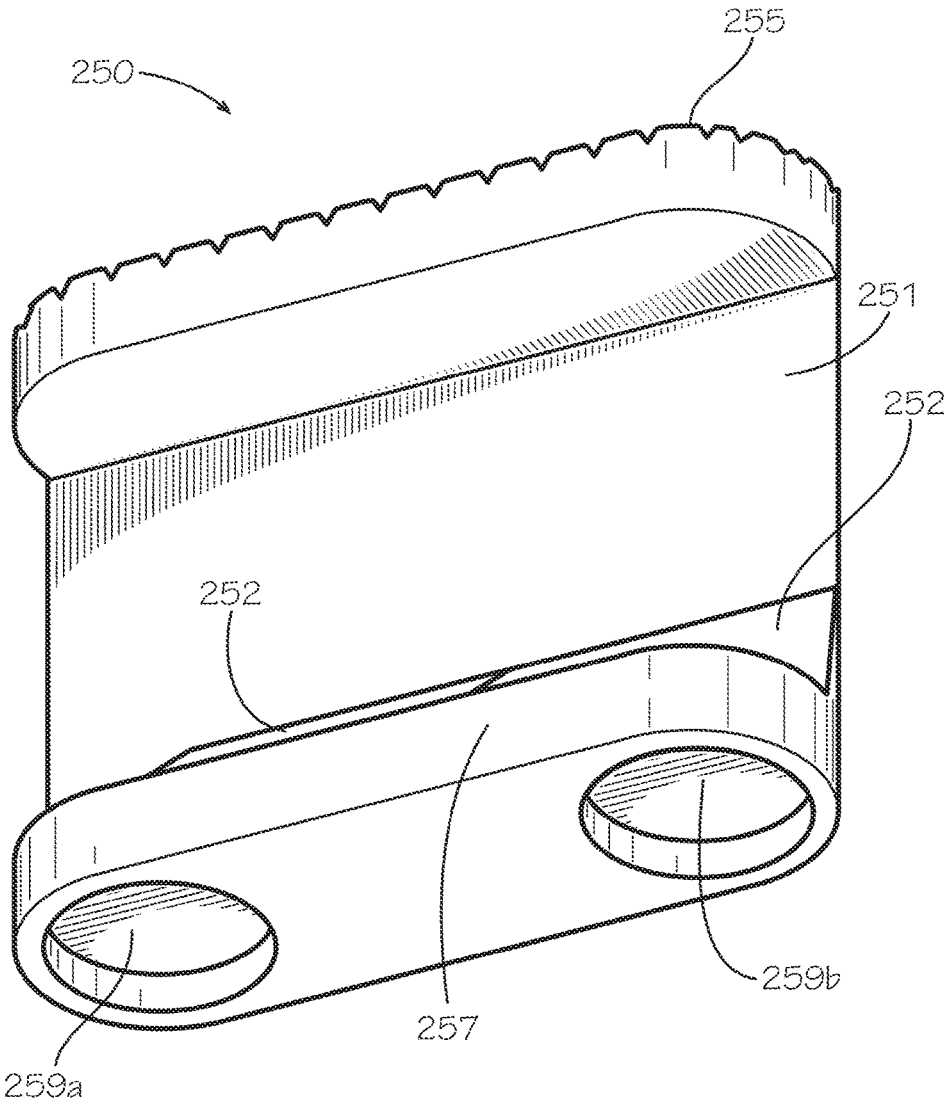
FIG. 13 is a bottom inside perspective view of the locking actuator of FIG. 12.

As shown in FIGS. 12 and 13, the locking actuator 250 can comprise a first portion 255, which can be a top end, and a second portion 257, which can be a bottom end, distal from the first portion 255. A connecting portion 251, which can be considered an upright or column of the locking actuator 250, can extend from the first portion 255 to the second portion 257. The first portion 255 can define a surface 256. In one aspect, as shown the surface 256 can be textured, which can, for example and without limitation, help a user easily locate and position a finger on the locking actuator 250 or help the user maintain the position of the finger on the locking actuator 250 while adjusting a position of the extension element 300 with respect to the base 210. Each of the teeth 252 of the locking actuator 250 can comprise a sloping portion 253 and a stop portion 254. Both a surface of the sloping portion 253 and a surface of the stop portion 254 can be angled with respect to a surface of an inside wall 258 of the locking actuator 250. In one aspect, a surface of the sloping portion 253 can be angled at an angle of 20 degrees with respect to the surface of the inside wall 258. In another aspect, a surface of the sloping portion 253 can be angled at an angle of between zero and 90 degrees with respect to the surface of the inside wall 258. In one aspect, a surface of the stop portion 254 can be angled at an angle of 90 degrees with respect to the surface of the inside wall 258. In another aspect, a surface of the stop portion 254 can be angled at an angle measuring less than or greater than 90 degrees with respect to the surface of the inside wall 258. The stop portion 254 of the locking actuator 250 can be oriented normal to the axis 301 and positioned at a rear end of each tooth 252 to better resist the recoil impulse of the firearm 100 during its firing. More specifically, the adjustable firearm stock 200 can be so designed to resist the compressive force that results between the stop portion 254 of the locking actuator 250 and the stop portion 334 of the extension element 300 during the firing of the firearm 100.

In one aspect, as shown in FIG. 12, the tooth can have a lower profile that occupies less space in the area between the first portion 255 and the second portion 257. In one aspect, as shown in FIG. 4, each of the teeth 252 can have a higher or taller profile that occupies more space in the area between the first portion 255 and the second portion 257. As shown in FIG. 13, the second portion 257 can define at least one cavity 259*a,b*, which can receive a portion of the activator-biasing mechanism 260. In one aspect, the second portion 257 of the locking actuator 250 can comprise a pair of the cavities 259*a,b*, one cavity 259*a,b* each for each of the pair of springs 265 of the activator-biasing mechanism 260. In another aspect, a single unbroken cavity can be defined in and extend across a bottom surface of the locking actuator 250 to accommodate the activator-biasing mechanism 260.

Figure 14:
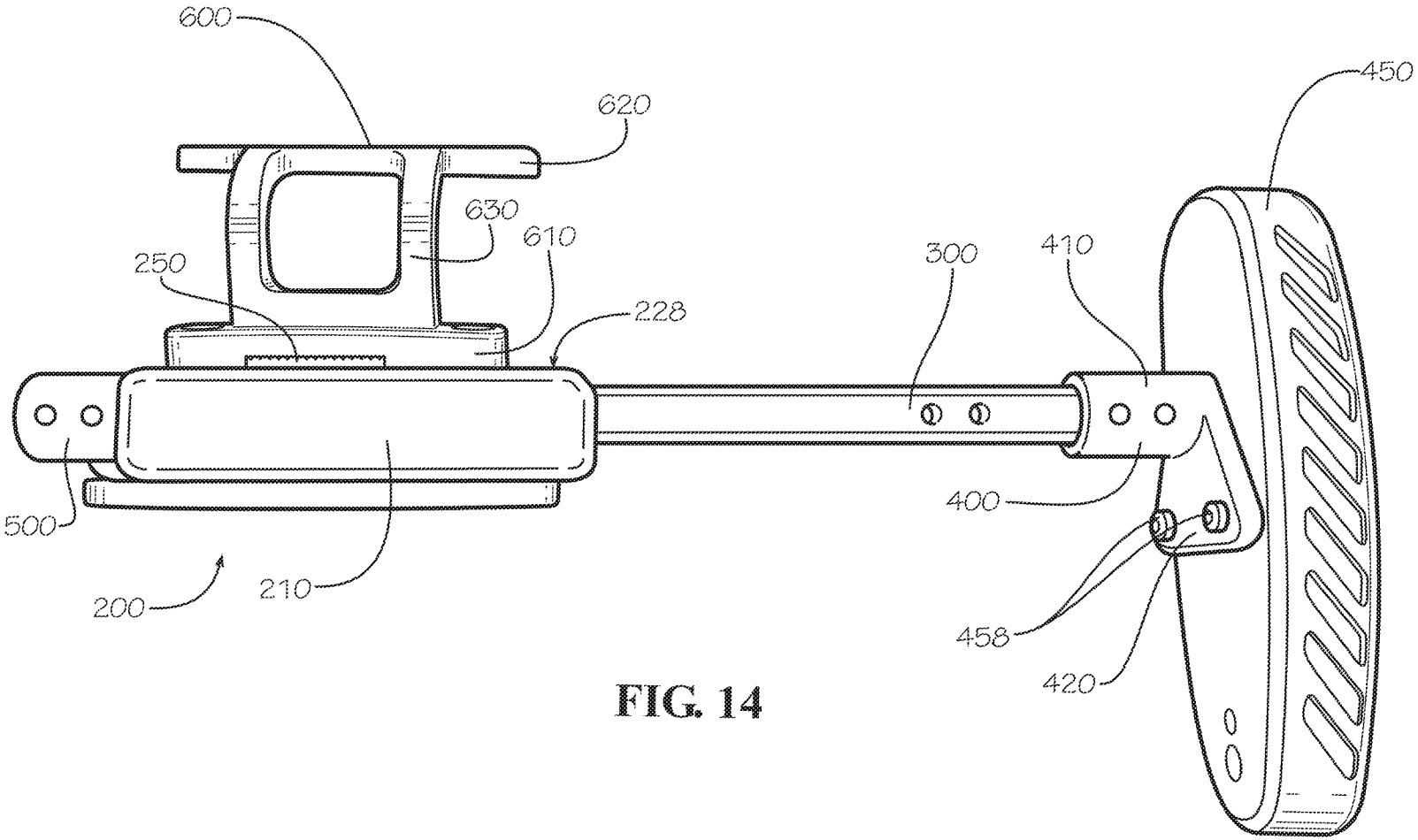
FIG. 14 is a side perspective view of an assembly comprising the adjustable firearm stock of FIG. 1 in accordance with another aspect of the current disclosure.

As shown in FIG. 14, the adjustable firearm stock 200 can comprise the pad 450 attached to the end accessory 400. In one aspect, as shown, the second portion 420 of the end accessory 400 can extend downwards from the first portion 410. In another aspect, as shown in FIG. 2, the second portion 420 of the end accessory 400 can extend to the left or the right from the first portion 410. In one aspect, the pad 450 can extend in a substantially vertical direction. The pad 450 can be secured to the end accessory 400 with fasteners 458.

The adjustable firearm stock 200 can also comprise an accessory mount 600 that can mount to a top surface 228 of the base 210. The accessory mount 600 can comprise a first mounting portion 610 configured to contact the top surface 228 of the base 210. The accessory mount 600 can comprise a second mounting portion 620, which can in one aspect be configured to receive an accessory such as a scope (not shown). In another aspect, the second mounting portion 620 can be configured to receive the accessory rail 1600 (shown in FIG. 16) such as, for example and without limitation, the aforementioned Picatinny, MIL-STD-1913, or Weaver rails. In yet another aspect, the second mounting portion 620 can comprise a rail comprising an RSM mount. A riser 630 can extend between and connect the first mounting portion 610 and the second mounting portion 620. In one aspect, the riser 630 can bend up and over the firearm 100 such that the accessory mounted to the accessory mount is directly above the bore axis 121 (shown in FIG. 1).

Figure 15:
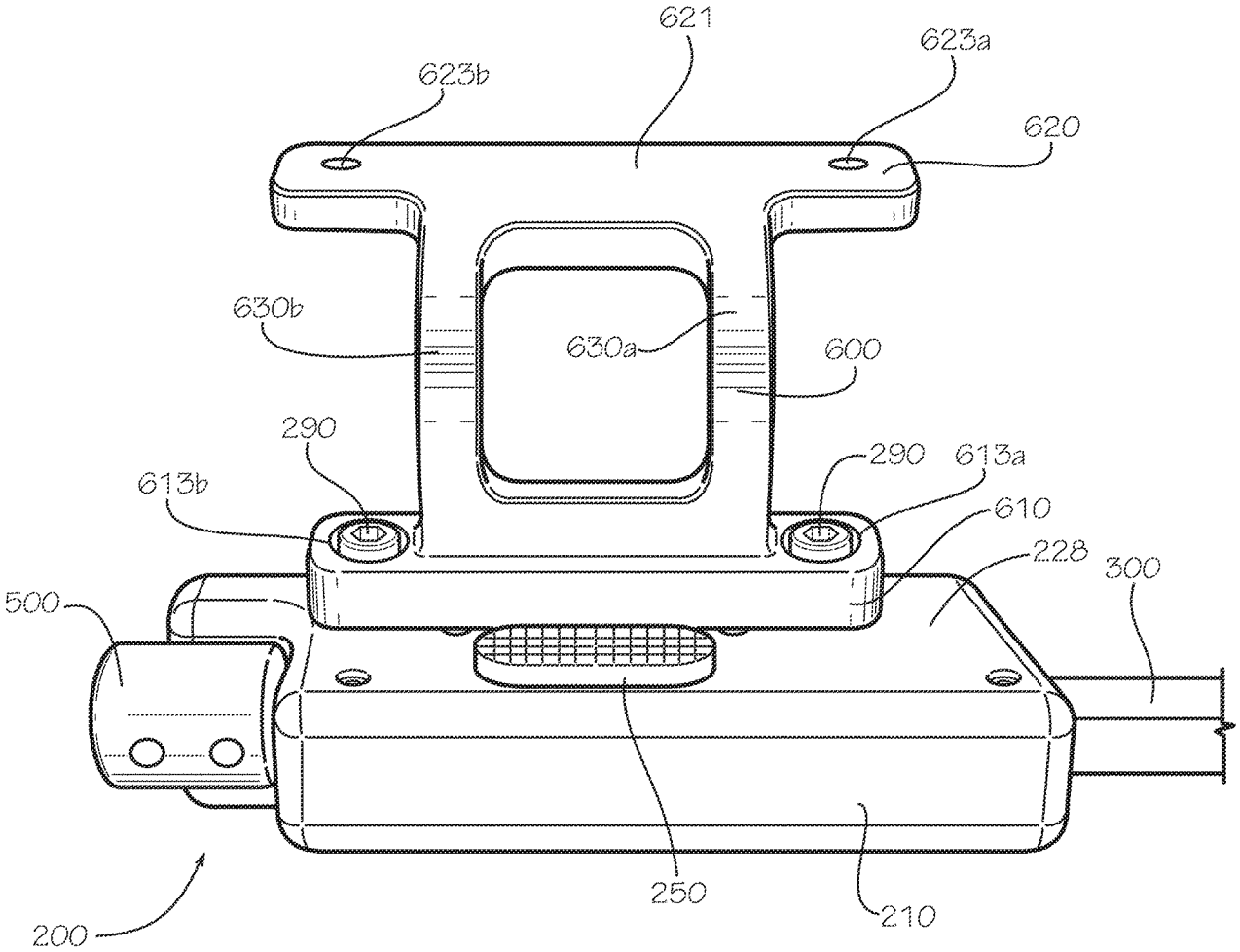
FIG. 15 is a detail view of an accessory bracket of the assembly of FIG. 14.

As shown in FIG. 15, the first mounting portion 610 of the accessory mount 600 can define mounting bores 613*a,b* positioned proximate first and second ends of the first mounting portion 610. Each of the mounting bores 613*a,b* can be sized to receive the body assembly fastener 290 and can be counterbored to receive the head 292 of each body assembly fastener 290. The second mounting portion 620 of the accessory mount 600 can define mounting bores 623*a,b* positioned proximate first and second ends of the second mounting portion 620. The mounting bores 623*a,b* can be sized to receive fasteners (not shown) for mounting an accessory (not shown) or a rail such as the accessory rail 1600 (shown in FIG. 16) to which the accessory can be secured. Each of the mounting bores 623*a,b* can be tapped to receive the threaded shank of a rail mounting fastener (not shown) or an accessory mounting fastener (not shown). The second mounting portion 620 can further comprise a mounting surface 621. The riser 630 can comprise a first riser portion 630*a* and a second riser portion 630*b*.

Figure 16:
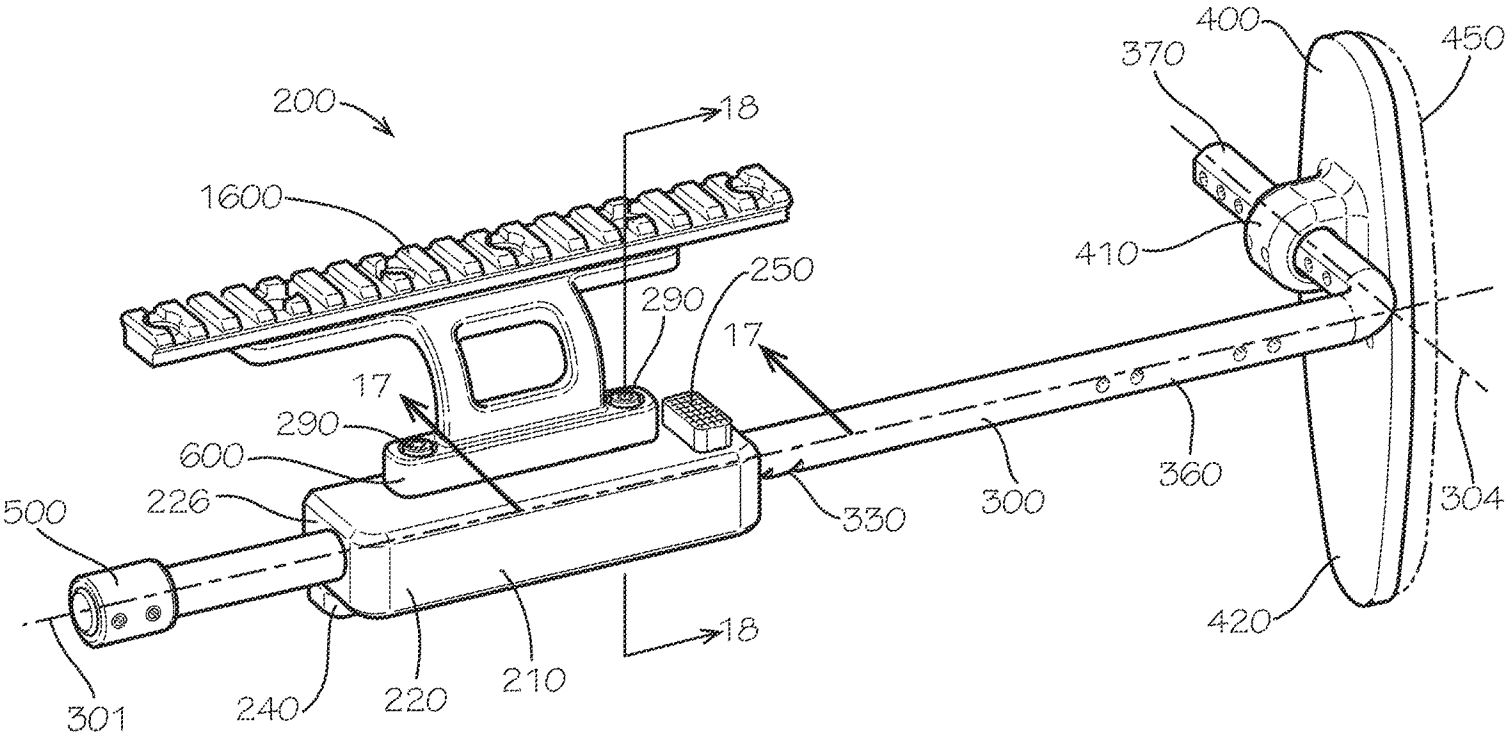
FIG. 16 is a perspective view of the adjustable firearm stock in accordance with another aspect of the current disclosure.

As shown in FIG. 16, the locking actuator 250 of the adjustable firearm stock 200 can be positioned proximate to the first end surface 225 (shown in FIG. 17) as shown or the second end surface 226. The locking actuator 250 can be centered about the axis 301 of the extension element 300. Moreover, a lengthwise direction of the locking actuator bore 233 can be oriented at 90 degrees with respect to the axis 301 and to the orientation shown in FIG. 1. In other aspects, the lengthwise direction of the locking actuator bore 233 (shown in FIG. 17) and the locking actuator 250 itself can be oriented at a different angle than that shown in FIG. 1 or in FIG. 16. In some aspects, the extension element 300 can extend through an opening 1910 (shown in FIG. 19) defined in the locking actuator 250. As shown, the extension element 300 can comprise a first portion extending along the axis 301 and a second portion 370 extending along a secondary axis 304, which can be angled with respect to the axis 301.

Figure 17:
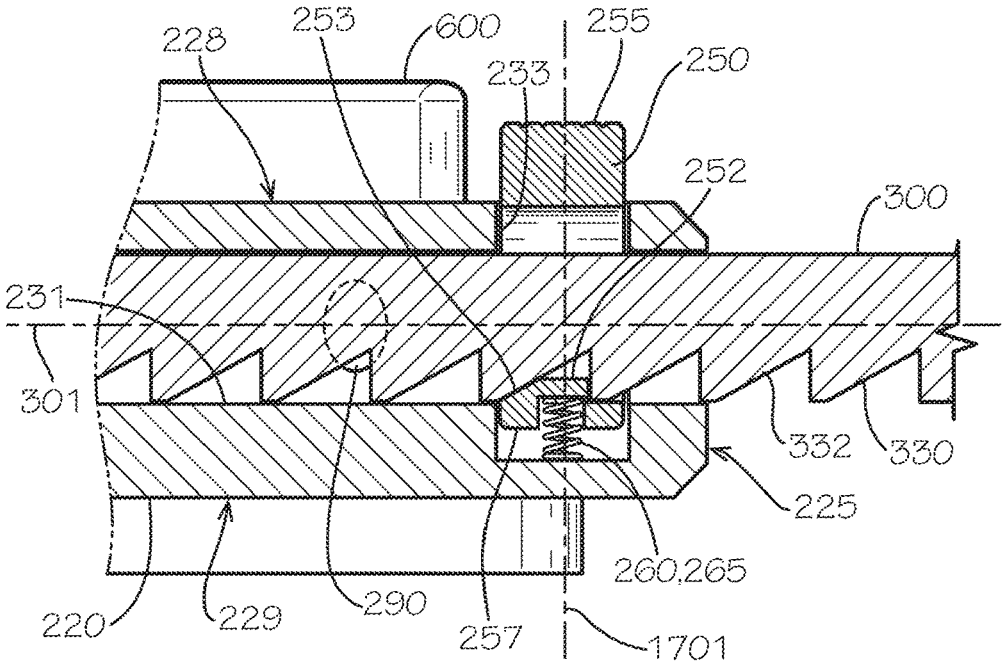
FIG. 17 is a sectional view of the adjustable firearm stock of FIG. 16 taken from line 17-17 of FIG. 16.

In one aspect, as shown in FIG. 17, the engagement feature 330 and, more specifically, sloping surfaces of the indentations 332 of the engagement feature 330 can face away from the first portion 255 of the locking actuator 250 and away from the top surface 228 of the upper base body 220, i.e., downward when the firearm 100 is positioned right-side up; and the engagement feature 330 and, more specifically, the sloping surfaces of the indentations 332 of the engagement feature 330 can face toward from the second portion 257 of the locking actuator 250 and toward the bottom surface 229 of the upper base body 220 and toward the direction of the centerline axis 1701 of the locking actuator 250. The sloping portion 253 of the tooth 252 of the locking actuator 250 can face toward the sloping surface of any one of the indentations 332. As described above, pushing down the locking actuator 250 relative to the upper base body 220 can disengage the tooth 252 from the engagement features 330 of the extension element 300, which can allow movement of the extension element 300 relative to the upper base body 220. In another aspect, the engagement feature 330 and, more specifically, the sloping surfaces of the indentations 332, can be made to face the opposite direction. The locking actuator 250 modified accordingly.

Figure 18:
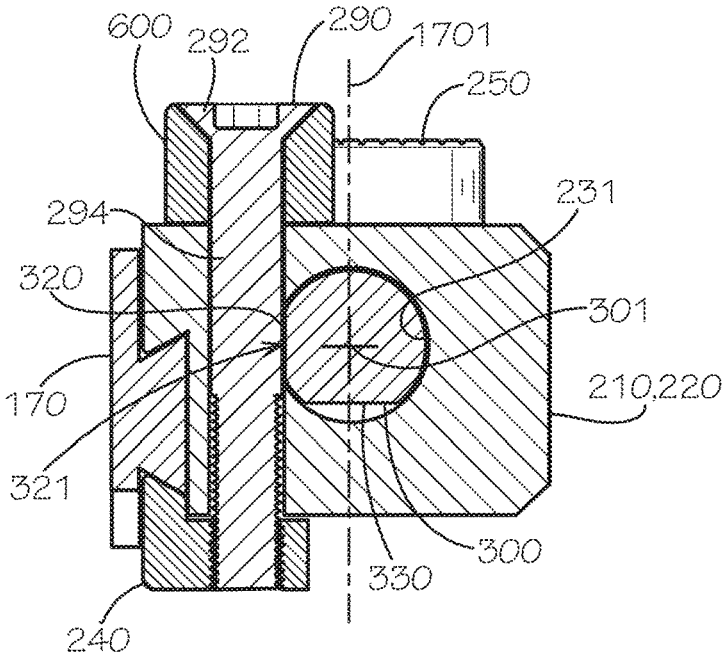
FIG. 18 is a sectional view of the adjustable firearm stock of FIG. 16 taken from line 18-18 of FIG. 16.

As shown in FIG. 18, the second side surface 321 of the second side 320 of the extension element 300 can ride against the shank 294 of each of the body assembly fasteners 290. Movement of the extension element 300 in a direction orthogonal to the axis 301 caused by looseness between the extension element 300 and the extension element bore 231 can be minimized or eliminated by the shank 294 of each of the body assembly fasteners 290. The shank 294 of the body assembly fasteners 290 can thereby replace the function of and obviate the need for the aforementioned pins 280 (shown in FIG. 4). Each of the body assembly fasteners 290 can comprise a head 292 defining a countersunk shape as shown.

Figure 19:
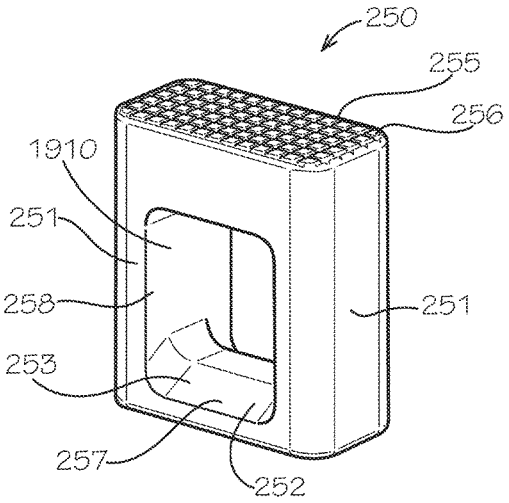
FIG. 19 is a top front perspective view of a locking actuator of the adjustable firearm stock of FIG. 16.
Figure 20:
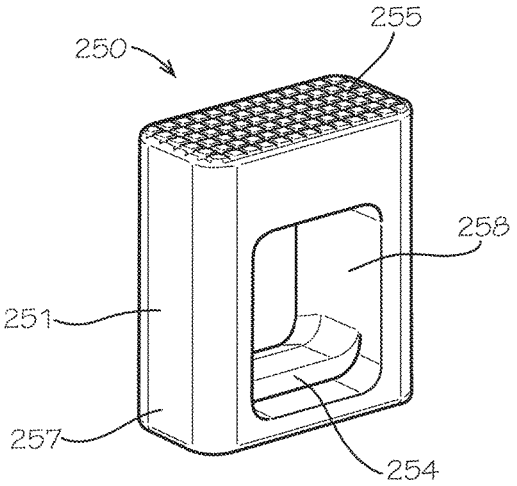
FIG. 20 is a top rear perspective view of the locking actuator of FIG. 19.
Figure 21:
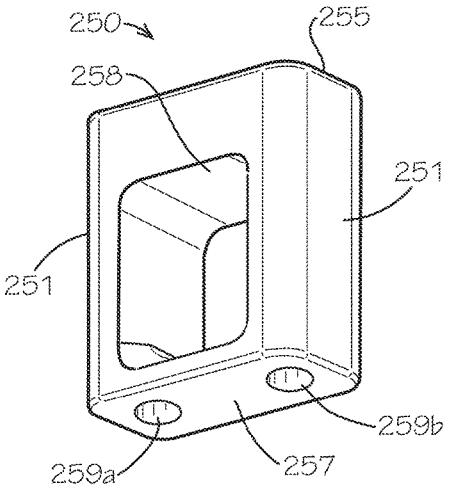
FIG. 21 is a bottom front perspective view of the locking actuator of FIG. 19.

FIGS. 19-21 show the locking actuator 250 in accordance with an aspect of the disclosure shown in FIGS. 16-18. In one aspect, as shown in FIG. 19, the connection portion 251 extending from the first portion 255 to the second portion 257 can be formed on both lateral sides of the tooth 252, thereby forming the opening 1910 therethrough. In another aspect, the connection portion 251 can be formed on just one side of the tooth 252. In another aspect, the locking actuator 250 can have a different shape from that show when viewed from the front, rear, side, top, or bottom. As shown, the inside wall 258 can define the opening 1910 of the locking actuator 250. As shown in FIG. 20, the stop portion 254 can be defined in the tooth 252 on a side opposite from the sloping portion 253 (shown in FIG. 19). As shown in FIG. 21, the locking actuator 250 can define the aforementioned bores 259*a,b* in the second portion 257.

The adjustable firearm stock 200 can comprise additional features as desired. For example, the end accessory 400 or the pad 450 can further comprise a biasing mechanism (not shown) configured to allow rotation of the end accessory or the pad 450 about the axis 301 with respect to the extension element 300. In addition, in another aspect of the adjustable firearm stock 200, the body assembly fasteners 290 can comprise a quick-release tightening mechanism (not shown) configured to tighten the adjustable firearm stock 200 to the firearm 100 without a separate tool. In one aspect, for example and without limitation, the head 292 of each of the body assembly fasteners 290 can incorporate a cam mechanism that allows gross adjustment and/or fine adjustment of the distance 217 and then "locking" of the adjustable firearm stock 200 around the rail mount plate 170. In another aspect, the lower jaw 243 can be replaced with one or more cams configured to engage the dovetail portion 172 of the rail mount plate 170 upon rotation of each of the one or more cams. Each cam can define either a variable perimeter thickness or a variable outer radius or both the variable perimeter thickness and the variable outer radius and can be configured to exert an increasing force on the dovetail portion 172 as the cams are rotated.

A method of using a firearm 100 can comprise securing a rail mount plate 170 to the side vertical surface 117,119 of the receiver 110 of the firearm 100. The method can further comprise mounting the base 210 of the adjustable firearm stock 200 to the rail mount plate 170 of the firearm 100. The method can further comprise sliding an extension element 300 of the adjustable firearm stock 200 along the axis 301 of the extension element bore 231 of the base 210 and within the extension element bore 231 of the base. The method of mounting the base 210 of the adjustable firearm stock 200 to the rail mount plate 170 can further comprise bringing the lower jaw 243 of the base 210 towards the upper jaw 223 of the base 210 to secure the base 210 to the rail mount plate 170. The method can further comprise engaging a tooth 252 of the locking actuator 250 with an indentation 332 defined in the extension element 300. The method can further comprise moving the extension element 300 along the axis 301 of the extension element bore 231 by operation of the locking actuator 250. The method can further comprise resting a one of the end accessory 400 and the pad 450 against the user. The method can further comprise securing the adjustable firearm stock 200 tightly to the firearm 100 such that the adjustable firearm stock 200 cannot move with respect to the firearm 100 at any point during use except when the adjustable firearm stock 200 is being adjusted.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. An adjustable firearm stock comprising:

a base configured to mount on a rail of a firearm, the base comprising:

an upper base body defining a first side surface defining an upper jaw, a second side surface distal from the first side surface, a first end surface, a second end surface distal from the first end surface, a top surface, a bottom surface distal from the top surface, an extension element bore extending from the first end surface to the second end surface, and a locking actuator bore extending from a one of the second side surface, the top surface, and the bottom surface into the upper base body; and a locking actuator positioned in the locking actuator bore; and an extension element positioned in the extension element bore of the upper base body, the extension element configured to move along an axis defined by the extension element by operation of the locking actuator.

2. The adjustable firearm stock of claim 1, further comprising an end accessory coupled to the extension element and configured to rest against a user.

3. The adjustable firearm stock of claim 2, further comprising a lower base body defining a lower jaw, the lower base body secured to the upper base body.

4. The adjustable firearm stock of claim 3, wherein the upper base body and the lower base body define a receiving portion configured to receive a dovetail-shaped rail mount plate.

5. The adjustable firearm stock of claim 1, wherein a surface of the extension element contacts a fastener extending through a bore in the upper base body and is configured to slide along the fastener during movement of the extension element along the axis of the extension element bore.

6. The adjustable firearm stock of claim 5, wherein the fastener is a body assembly fastener, the body assembly fastener securing a one of a lower base body and an accessory mount to the upper base body.

7. The adjustable firearm stock of claim 1, wherein a cross-section of each of the extension element bore and the extension element is substantially circular.

8. The adjustable firearm stock of claim 1, wherein the extension element defines an engagement feature defining a plurality of indentations and the locking actuator defines a tooth, the tooth of the locking actuator configured to engage each of the plurality of indentations of the engagement feature.

9. The adjustable firearm stock of claim 1, wherein the locking actuator is biased in a locked position by an activator-biasing mechanism positioned between the locking actuator and the upper base body.

10. The adjustable firearm stock of claim 1, wherein a centerline axis of the locking actuator intersects the axis of the extension element.

11. A firearm comprising:

a rail secured to the firearm; and an adjustable firearm stock secured to the rail, the adjustable firearm stock comprising:

a base removably secured to the rail of the firearm and defining an extension element bore;

an extension element defining a first end defining a contact surface and a second end distal from the first end, the second end of the extension element extending at least partly through the extension element bore, the second end of the extension element positioned closer to a front end of the firearm than the first end of the extension element, the extension element configured to move along an axis of the extension element bore; and an end accessory secured to the first end of the extension element, the end accessory defining a contact surface having a greater surface area than a surface area of the contact surface of the first end of the extension element.

12. The firearm of claim 11, wherein a cross-section of the extension element is substantially circular.

13. The firearm of claim 11, wherein the rail of the firearm is a rail mount plate mounted to a side vertical surface of the firearm.

14. The firearm of claim 11, wherein the adjustable firearm stock further comprises a locking actuator positioned in a locking actuator bore defined in the base, the locking actuator bore angled with respect to the extension element bore.

15. The firearm of claim 11, wherein an upper jaw of the base is positioned above the rail and a lower jaw of the base is positioned below the rail, the base defining a receiving portion configured to receive the rail and secure the base to the rail, the receiving portion of the base having a dovetail shape in cross-section.

16. The firearm of claim 15, further comprising a body assembly fastener, the body assembly fastener configured to bring the lower jaw of the base toward the upper jaw of the base when the body assembly fastener is tightened.

17. A method of using a firearm comprising:

mounting a base of an adjustable firearm stock to a rail of the firearm, the rail mounted to a side vertical surface of the firearm;

sliding an extension element of the adjustable firearm stock through an extension element bore of the base to adjust the adjustable firearm stock to a desired orientation; and fixing a position of the extension element relative to the base by engaging a locking actuator of the adjustable firearm stock with the extension element.

18. The method of claim 17, further comprising bringing a lower jaw of the base towards an upper jaw of the base to secure the base to the rail.

19. The method of claim 17, wherein fixing a position of the extension element relative to the base in the direction of an axis of the extension element comprises engaging a tooth of the locking actuator with an indentation defined in the extension element.

20. The method of claim 17, further comprising moving the locking actuator from a locked position to an unlocked position by pressing the locking actuator into a locking actuator bore defined in the base.

21. A method of using a firearm comprising:

mounting a base of an adjustable firearm stock to a rail of the firearm;

bringing a lower jaw of the base towards an upper jaw of the base to secure the base to the rail;

sliding an extension element of the adjustable firearm stock through an extension element bore of the base to adjust the adjustable firearm stock to a desired orientation; and fixing a position of the extension element relative to the base by engaging a locking actuator of the adjustable firearm stock with the extension element.

* * * * *